US005262293A

United States Patent [19]

Ikesu et al.

[11] Patent Number: 5,262,293

[45] Date of Patent: Nov. 16, 1993

[54] PHOTOGRAPHIC CYAN COUPLER

[75] Inventors: Satoru Ikesu, Hino; Hiroshi Kita, Sagamihara; Yutaka Kaneko, Hino, all of Japan

[73] Assignee: Konica Corporation, Tokyo, Japan

[21] Appl. No.: 953,069

[22] Filed: Sep. 29, 1992

[30] Foreign Application Priority Data

Oct. 22, 1991 [JP] Japan ..... 3-274130
Oct. 22, 1991 [JP] Japan ..... 3-274131

[51] Int. Cl.[5] ..... G03C 7/38

[52] U.S. Cl. ..... 430/558; 430/384; 430/385

[58] Field of Search ..... 430/558, 384, 385

[56] References Cited

U.S. PATENT DOCUMENTS 4,500,630 2/1985 Sato et al. ..... 430/558

FOREIGN PATENT DOCUMENTS 3281161 11/1988 Japan ..... 430/558
4-78583 3/1992 Japan .
4-194847 7/1992 Japan .

*Primary Examiner*—Lee C. Wright
*Attorney, Agent, or Firm*—Finnegan, Henderson, Farabow, Garrett & Dunner

[57] ABSTRACT

A silver halide color photographic light-sensitive material is disclosed. The light-sensitive material comprises a support having thereon a silver halide emulsion layer containing a coupler represented by the following formula I or II;

(I)

wherein $R_1$ is a hydrogen atom or a group having a Hammet's $\sigma p$ value of 0 or more; X1 is a hydrogen atom or a substituent capable of splitting off upon reaction with the oxidation product of a color developing agent; $Y_1$ is a hydrogen atom or a substituent; and $Z_1$ is a group of non- metal atoms necessary for forming an aromatic six-member heterocyclic ring which may have a substituent, (II)

wherein $R_2$ and $Y_2$ are independently a hydrogen atom or a substituent; $X_2$ is a hydrogen atom or a substituent capable of splitting off upon reaction with the oxidation product of a color developing agent; and $Z_2$ is a group of non-metal atoms necessary for forming an aromatic five-member heterocyclic ring which may have a substituent.

6 Claims, No Drawings

PHOTOGRAPHIC CYAN COUPLER

FIELD OF THE INVENTION

The present invention relates to a Silver halide photographic color light-sensitive material containing a cyan coupler, particularly to a light-sensitive material containing a coupler capable of forming a dye image excellent in spectral absorption characteristics and fastness to heat, moisture and light.

BACKGROUND OF THE INVENTION

Color images are formed by subjecting an exposed silver halide photographic light-sensitive material to color development, in which an oxidized aromatic primary amine color developing agent is reacted with a dye-forming coupler to form a dye in the exposed area.

In general, color reproduction by the subtractive process is used in this photographic process and thereby yellow, magenta and cyan images are formed.

As a photographic coupler for yellow image formation, acylacetanilide type couplers, for example, are used. Couplers for magenta image formation include pyrazolone, pyrazolobenzimidazole, pyrazolotriazole and indazolone type couplers. And couplers for cyan image formation include phenol and naphthol type couplers.

Dye images so-obtained are required to have excellent spectral absorption characteristics and not to discolor even when exposed to light or stored under high temperature and high humidity conditions for a long time.

However, phenol type and naphthol type couplers which have been used and studied as a cyan dye image forming coupler are not necessarily satisfactory in spectral absorption characteristics, heat stability, moisture stability and light fastness of cyan images formed therefrom. Although various proposes including contrivances on the substituent have been made to develop a compound improved in these points, no compound has so far succeeded in satisfying all of them.

SUMMARY OF THE INVENTION

Accordingly, a first object of the invention is to provide a silver halide color photographic material containing a novel coupler.

A second object of the invention is to provide photographic material containing a coupler capable of forming cyan dye images excellent in spectral absorption characteristics.

A third object of the present invention is to provide a photographic material containing a coupler capable of forming cyan dye images which do not change in hue when exposed to heat, moisture and light.

The object of the invention is achieved by a silver halide color light-sensitive material comprising a support and a silver halide emulsion layer provided thereon, in which a coupler represented by the following formula I or II;

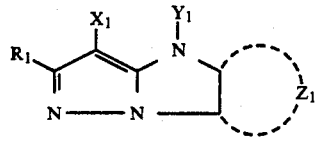

(I)

wherein $R_1$ is a hydrogen atom or a group having a Hammet's $\sigma p$ value of 0 or more; X1 is a hydrogen atom or a substituent capable of splitting off upon reaction with the oxidation product of a color developing agent; $Y_1$ is a hydrogen atom or a substituent; and $Z_1$ is a group of non-metal atoms necessary for forming a six-member heterocyclic ring which may have a substituent,

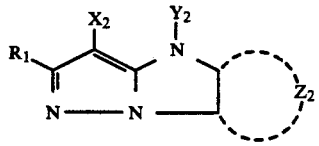

(II)

wherein $R_2$ and $Y_2$ are independently a hydrogen atom or a substituent; $X_2$ is a hydrogen atom or a substituent capable of splitting off upon reaction with the oxidation product of a color developing agent; and $Z_2$ is a group of non-metal atoms necessary for forming an five-member heterocyclic ring which may have a substituent.

DETAILED DESCRIPTION OF THE INVENTION

In Formula I, $R_1$, which represents a hydrogen atom or a substituent having a Hammett's $\sigma p$ not less than 0, is typically a hydrogen atom, a cyanomethyl group, aminomethyl group, a pentachlorophenyl group, a 2,4,6-trinitrophenyl group, a sulfonamido group such as octylsulfonamido and phenylsulfonamido group, a cyano group , a nitro group, a sulfonyl group such as octylsulfonyl, phenylsulfonyl, trifluoromethylsulfonyl, and pentafluorophenylsulfonyl group, a $\beta$-carboxyvinyl group, a sulfinyl group such as t-butylsulfinyl, tolylsulfinyl, trifluoromethylsulfinyl and pentafluorophenylsulfinyl group, a $\beta,\beta$-dicyanovinyl group, a halogenated alkyl group such as trichloromethyl, chloromethyl, trifluoromethyl, perfluorooctyl and $\omega$-hydroperfluorododecyl group, a formyl group, a carboxyl group such as acetyl, pivaloyl, benzoyl and trifluoroacetyl group, an alkyloxycarbonyl or aryloxycarbonyl group such as ethoxycarbonyl and phenoxycarbonyl group, a 1-tetrazolyl group, a 5-chloro-1-tetrazolyl group, a carbamoyl group such as dodecylcarbamoyl and phenylcarbamoyl group or a sulfamoyl group such as trifluoromethylsulfamoyl, phenylsulfamoyl and ethylsulfamoyl group.

The group represented by X, which is capable of splitting off upon reaction with an oxidation product of a color developing agent, includes, for example, a halogen atom, such as a chlorine, bromine and fluorine atom, and groups of alkoxy, aryloxy, heterocycloxy, acyloxy, sulfonyloxy, alkoxycarbonyloxy, aryloxycarbonyl, alkyloxalyloxy, alkoxyoxalyloxy, alkylthio, arylthio, heterocyclothio, alkyloxythiocarbonylthio, acylamino, sulfonamido, N-atombonded nitrogen-containing heterocycle, alkyloxycarbonylamino, aryloxycarbonylamino, carboxyl and

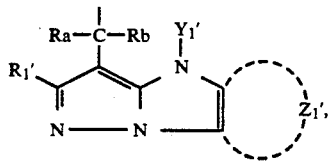

in which $R_1'$, $Z_1'$and $Y_1'$ are the same as the above R, Z and Y; Ra and Rb each represent a hydrogen atom or an aryl, alkyl or heterocyclic group, but a halogen atom is preferred. Among those represented by $X_1$, particularly preferred ones are a hydrogen atom and a chlorine atom.

In Formula I, $Y_1$ represents a hydrogen atom or a substituent. Suitable substituents represented by Y are those which are released from the compound of the invention when the compound reacts with an oxidation product of a developing agent. Examples thereof include the groups described in Japanese Pat. O. P. I. Pub. No. 228444/1986 which split off under alkaline conditions, and the substituents described in Japanese Pat. O. P. I. Pub. No. 13373/1981 which decouple upon reaction with an oxidation product of a developing agent; but, preferably, Y is a hydrogen atom.

Accordingly, the compounds of the inventionrepresented by Formula I are preferably represented by Formula I':

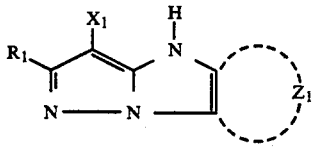

Formula I' wherein formula, $R_1$, $Z_1$ and $X_1$ are the same as $R_1$, $Z_1$ and $X_1$ of the compound represented by Formula I.

$Z_1$ is a group of nonmetal atoms necessary to form a six-membered aromatic heterocycle, which may have a substituent if necessary.

As a hetero-atom contained in said six-membered aromatic heterocycle, a nitrogen atom is preferred. Therefore, the compounds represented by Formula I' are more specifically represented by one of the following Formulas Ia to Ie, but are not limited to these formulas.

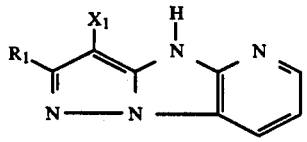

Formula Ia

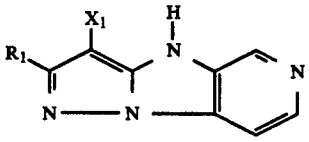

Formula Ib

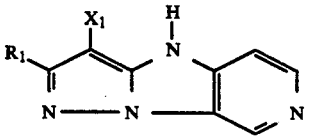

Formula Ic

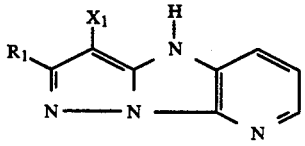

Formula Id

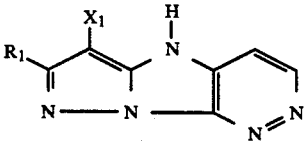

Formula Ie

In the formulas, $R_1$ and $X_1$ are the same as $R_1$ and $X_1$ in Formula I and Formula I'. The six-member aromatic heterocycle in Formulas Ia and Ie may have a substituent according to a specific requirement.

Typical examples of the compound of the invention are shown below.

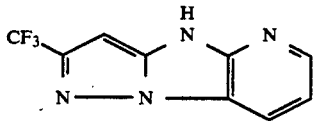

(I-1)

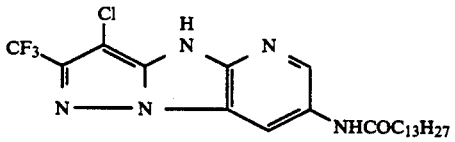

(I-2)

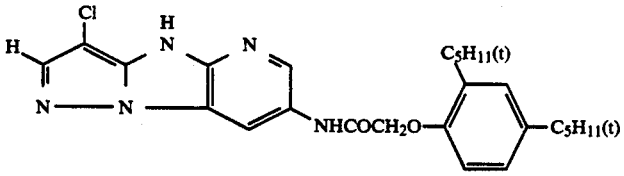

(I-3)

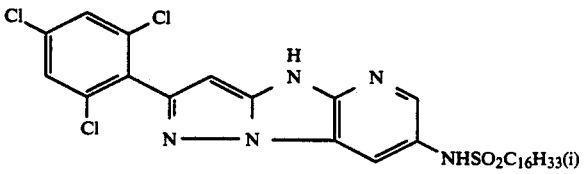

(I-4)

-continued
(I-5)
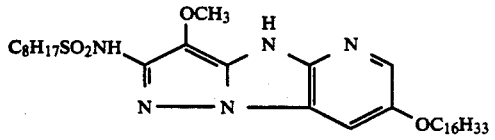
(I-6)
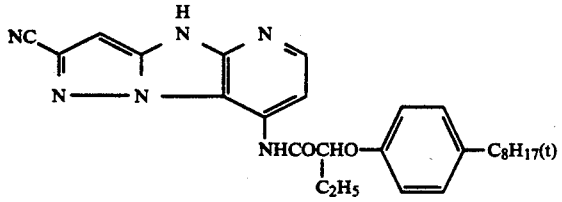
(I-7)
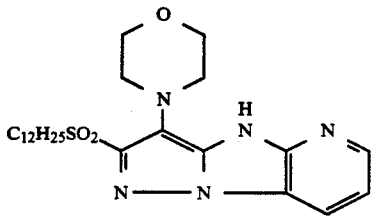
(I-8)
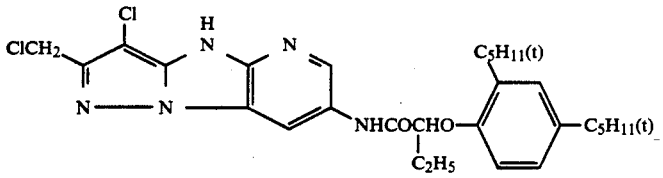
(I-9)
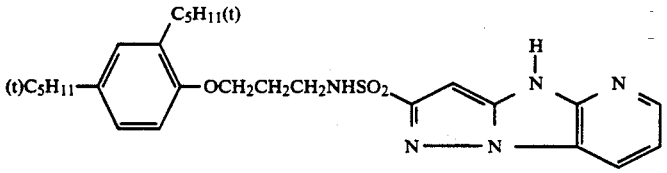
(I-10)
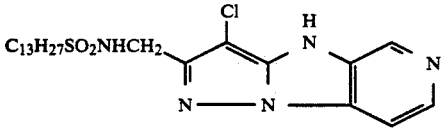
(I-11)
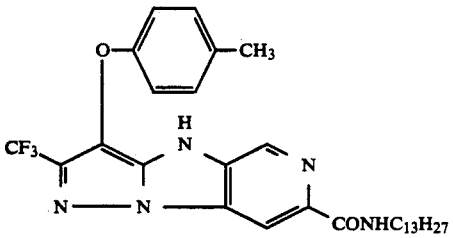
(I-12)
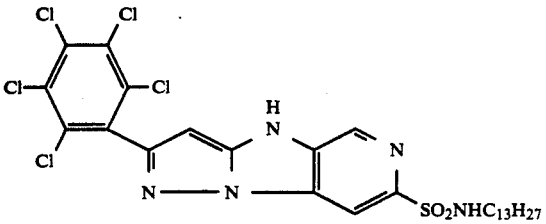

-continued
(I-13)
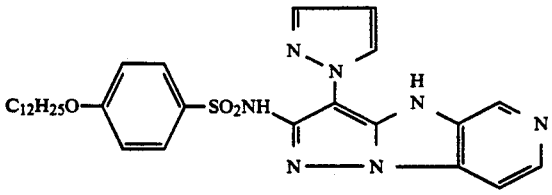
(I-14)
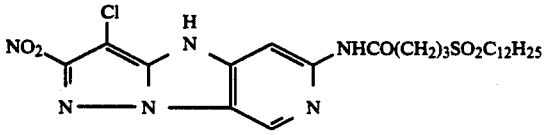
(I-15)
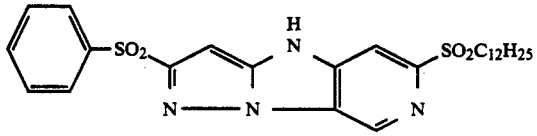
(I-16)
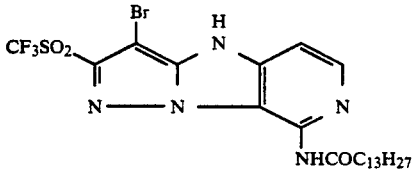
(I-17)
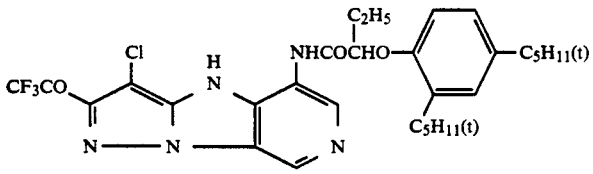
(I-18)
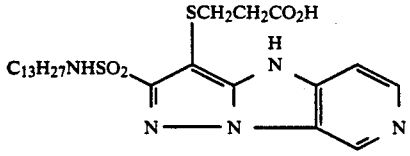
(I-19)
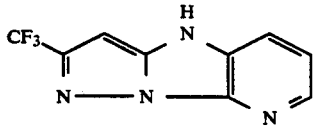
(I-20)
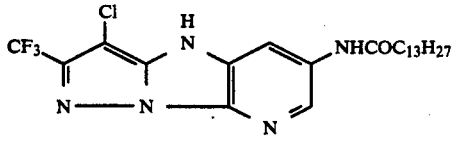
(I-21)
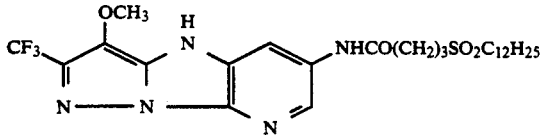

-continued (I-22)

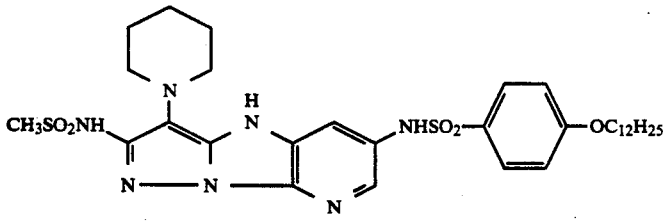

(I-23)

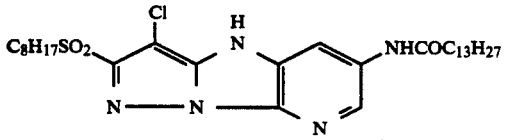

(I-24)

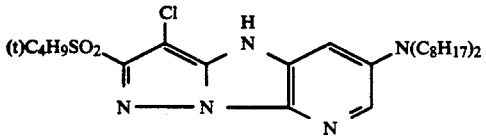

(I-25)

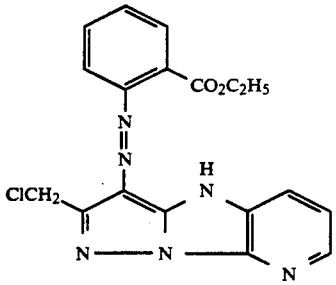

(I-26)

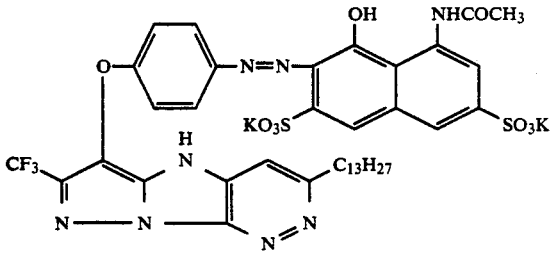

(I-27)

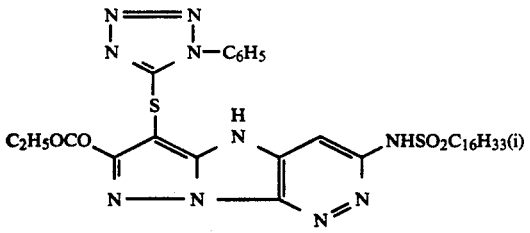

(I-28)

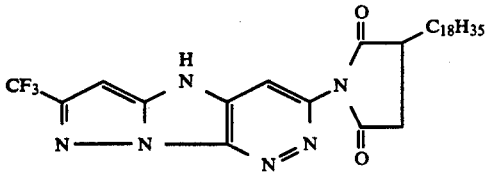

In formula II, the substituent represented by $R_2$, though not particularly limited, typically includes an alkyl, aryl, anilino, acylamino, sulfonamido, alkylthio, arylthio, alkenylthio and cycloalkyl group. Other examples include a halogen atom, and a cycloalkenyl, alkynyl, heterocyclic, sulfonyl, sulfinyl, phosphonyl, acyl, carbamoyl, sulfamoyl, cyano, alkoxy, aryloxy, heterocycloxy, siloxy, acyloxy, sulfonyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclothio, thioureido, carboxyl, hydroxyl, mercapto, nitro and sulfo group, and a spiro compound residue and a bridged hydrocarbon residue.

Each group represented by $R_2$ is hereunder described more specifically.

The alkyl group is preferably one having 1 to 32 carbon atoms and may be either straight-chained or branched.

The aryl group is preferably a phenyl group.

The acylamino group includes an alkylcarbonylamino and arylcarbonylamino group.

The sulfonamido group includes an alkylsulfonylamino and arylsulfonylamino group.

The alkyl moiety and aryl moiety in the alkylthio group and arylthio group include the above alkyl group and aryl group represented by $R_2$ above.

The alkenyl group is preferably one having 2 to 32 carbon atoms. The cycloalkyl group is preferably one having 3 to 12, especially 5 to 7 carbon atoms. The alkenyl group may be either straight-chained or branched.

The cycloalkenyl group is preferably one having 3 to 12, especially 5 to 7 carbon atoms. The sulfonyl group includes an alkylsulfonyl and arylsulfonyl group. The sulfinyl group includes an alkylsulfinyl and arylsulfinyl group. The phosphonyl group includes an alkylphosphonyl, alkoxyphosphonyl, arylphosphonyl and aryloxyphosphonyl group. The acyl group includes an alkylcarbonyl and arylcarbonyl group. The carbamoyl group includes an alkylcarbamoyl and arylcarbamoyl group. The sulfamoyl group includes an alkylsulfamoyl and arylsulfamoyl group. The acyloxy group includes an alkylcarbonyloxy and arylcarbonyloxy group. The sulfonyloxy group includes an alkylsulfonyloxy and arylsulfonyloxy group. The carbamoyloxy group includes an alkylcarbamoyloxy and arylcarbamoyloxy group. The ureido group includes an alkylureido and arylureido group. The sulfamoylamino group includes an alkylsulfamoylamino, and arylsulfamoylamino group. The heterocyclic group is preferably a five-to seven-membered one and typically a 2-furyl, 2-thienyl, 2-pyrimidinyl, 2-benzothiazoryl, 1-pyroryl, and 1-tetrazoryl group. The heterocycloxy group is preferably a five- to seven-membered one and typically a 3,4,5,6-tetrahydropyranyl-2-oxy and 1-phenyltetrazole-5-oxy group. The heterocyclothio group is preferably a five- to seven-membered heterocyclothio group, and typical examples thereof include a 2-pyridylthio, 2-benzothiazolylthio and 2,4-diphenoxy-1,3,5-triazole-6-thio group. The siloxy group includes a trimethylsiloxy, triethylsiloxy and dimethylbutylsiloxy group. The imido group includes a succinimido, 3-heptadecylsuccinimido, phthalimido and glutarimido group. The spiro compound residue includes a spiro[3,3]heptane-1-yl. The bridged hydrocarbon residue includes a bicyclo[2,2,1]heptane-1-yl, tricyclo[3,3,1,1$^{37}$]decane-1-yl, 7,7-dimethylbicyclo[2,2,1]heptane-1-yl.

The above groups may further have a substituent including an antidiffusible group such as a long-chain hydrocarbon group or a polymer residue.

Examples of the group represented by $X_2$, which can split off upon reaction with an oxidation product of a color developing agent, include a halogen atom such as a chlorine, bromine and fluorine atom, and an alkylene, alkoxy, aryloxy, heterocycloxy, acyloxy, sulfonyloxy, alkoxycarbonyloxy, aryloxycarbonyl, alkyloxalyloxy, alkoxyoxalyloxy, alkylthio, arylthio, heterocyclothio, alkyloxythiocarbonylthio, acylamino, sulfonamido, thereof, nitrogen-containing heterocycle bonded through N-atom alkyloxycarbonylamino, aryloxycarbonylamino and carboxyl group and

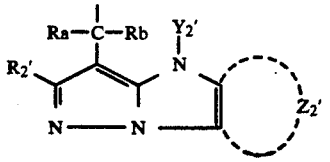

$R_2'$ is the same as the above $R_2$; $Y_2'$ and $Z_2'$ are the same as the above $Y_2$ and $Z_2$; Ra and Rb each represent a hydrogen atom, or an aryl, alkyl or heterocyclic group. Among those represented by $X_2$, a halogen atom is preferred.

$Y_2$ represents a hydrogen atom or a substituent. Preferable substituents, for example, are those which split off after reacting with an oxidized developing agent; examples thereof include the groups described in Japanese Pat. O. P. I. Pub. No. 228444/1986 which can split off under alkaline conditions, and the groups described in Japanese Pat. O. P. I. Pub. No. 133734/1981 which decouple upon reaction with an oxidized developing agent. But, Y is preferably a hydrogen atom.

Accordingly, among the compounds of the invention represented by Formula II, particularly preferred are those represented by Formula II'.

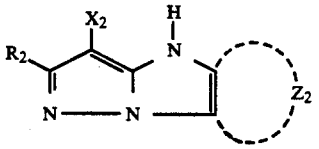

Formula II' wherein $R_2'$, $X_2$ and $Z_2$ are the same as $R_2$, $X_2$ and $Z_2$ in Formula II. $Z_2$ represents a group of nonmetal atoms necessary to form a five-member aromatic heterocycle which may have a substituent.

The heteroatom contained in said five-member aromatic heterocycle is preferably a nitrogen, sulfure or oxygen atom. The compounds represented by Formula II are more specifically expressed by the following Formulas IIa to IIf, but are not limited to them.

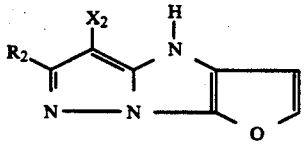

Formula IIa

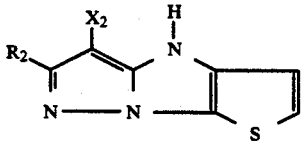

Formula IIb

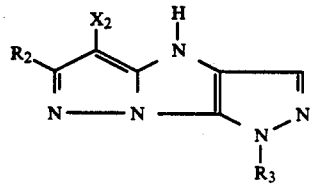

Formula IIa

-continued

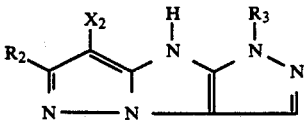

Formula IId

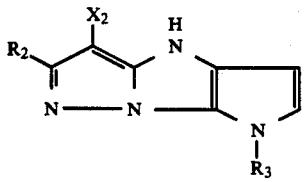

Formula IIe

-continued

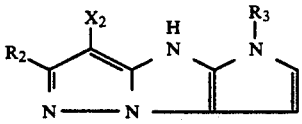

Formula IIf wherein $R_2'$, $X_2$ and $Z_2$ are the same as $R_2$, $X_2$ and $Z_2$ in Formulas II.

$R_3$ represents a substituent, examples thereof include an alkyl, aryl, alkenyl, cycloalkyl, sulfonyl, acyl, carbamoyl, sulfamoyl, alkoxycarbonyl and aryloxycarbonyl group.

The five-membered aromatic heterocycles represented by one of Foumulas IIa to IIf may have a substituent according to a specific requirement.

Typical examples of the compound of the invention are shown below.

(II-1)

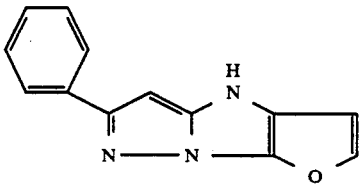

(II-2)

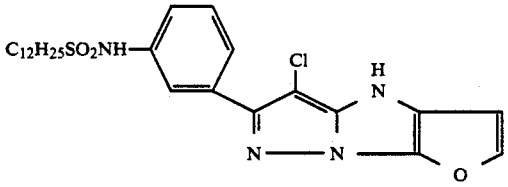

(II-3)

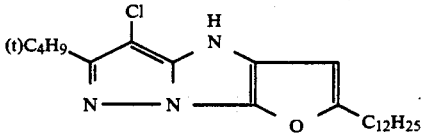

(II-4)

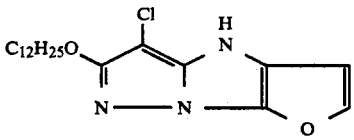

(II-5)

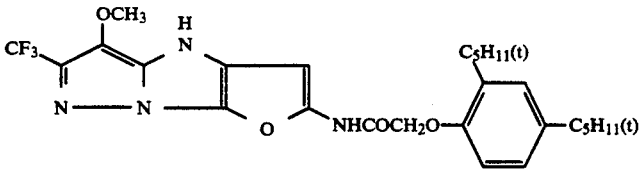

(II-6)

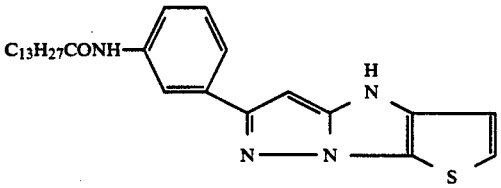

-continued
(II-7)
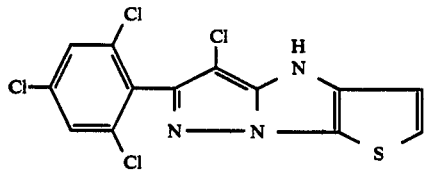
(II-8)
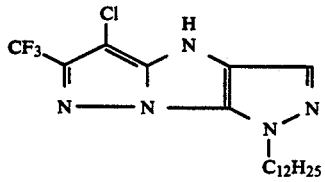
(II-9)
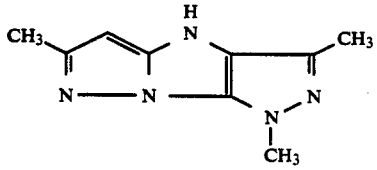
(II-10)
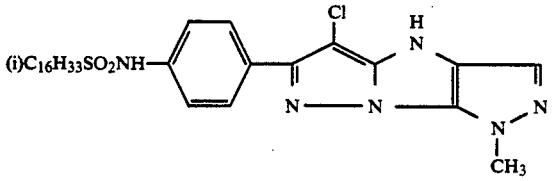
(II-11)
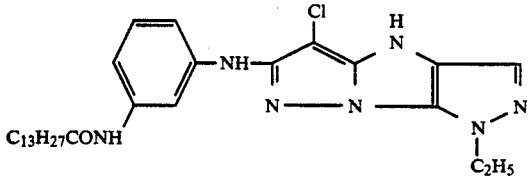
(II-12)
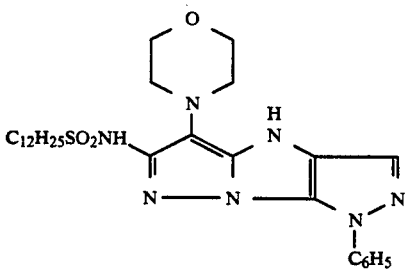
(II-13)
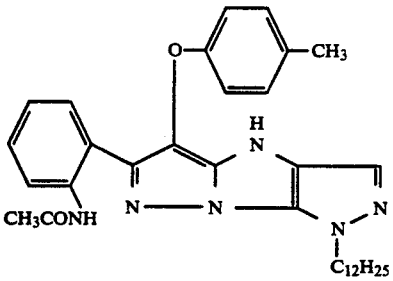
(II-14)
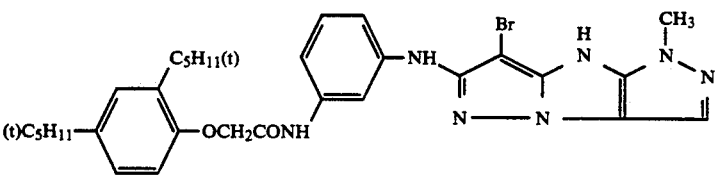

-continued
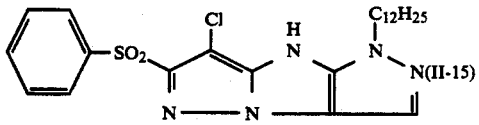
(II-16)
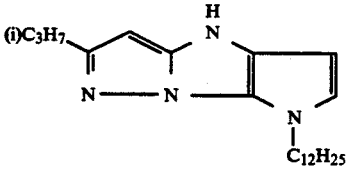
(II-17)
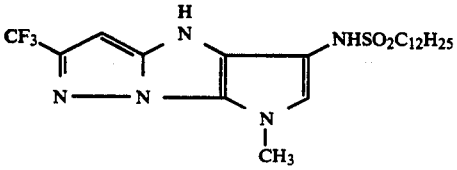
(II-18)
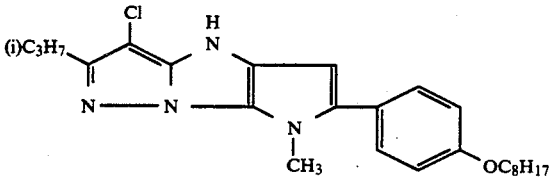
(II-19)
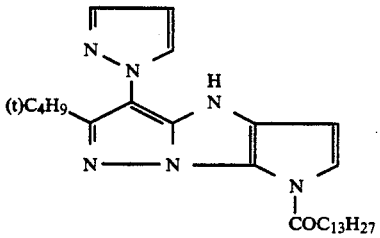
(II-20)
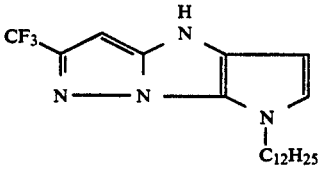
(II-21)
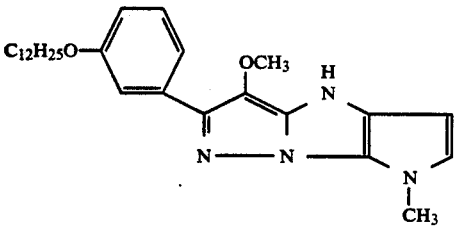
(II-22)
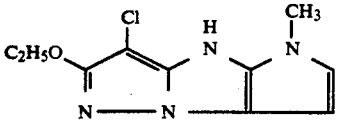

-continued
(II-23)
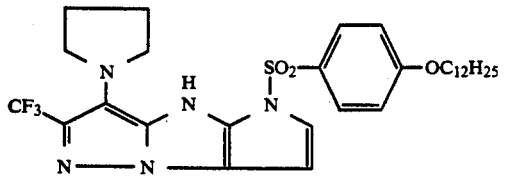
(II-24)
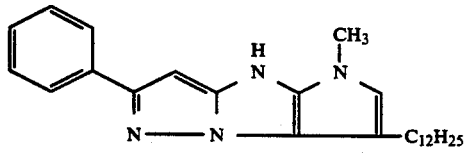
(II-25)
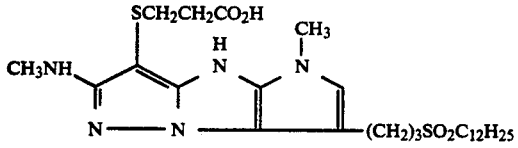
(II-26)
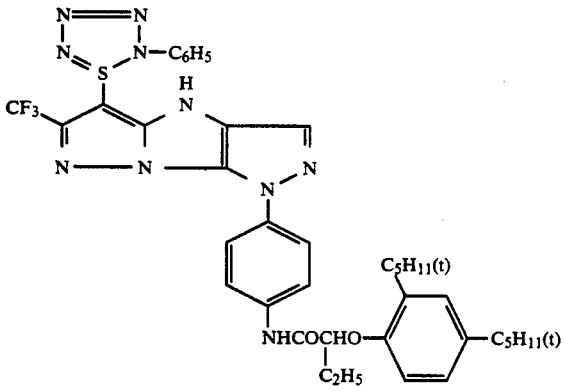
(II-27)
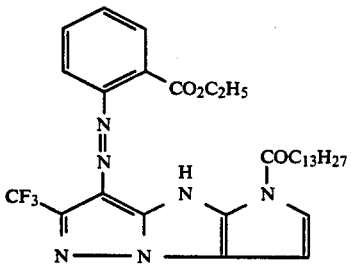
(II-28)
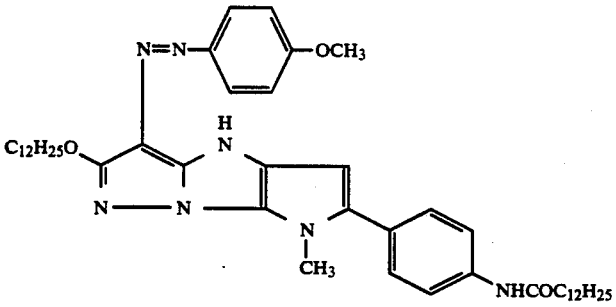
Next, a typical synthesis example of the compound of the invention is described. The other compounds of the invention can also be readily synthesized in similar manners.
Synthesis Example
Synthesis of Exemplified Compound (I-19)
Exemplified compound (I-19) is synthesized according to the following scheme:

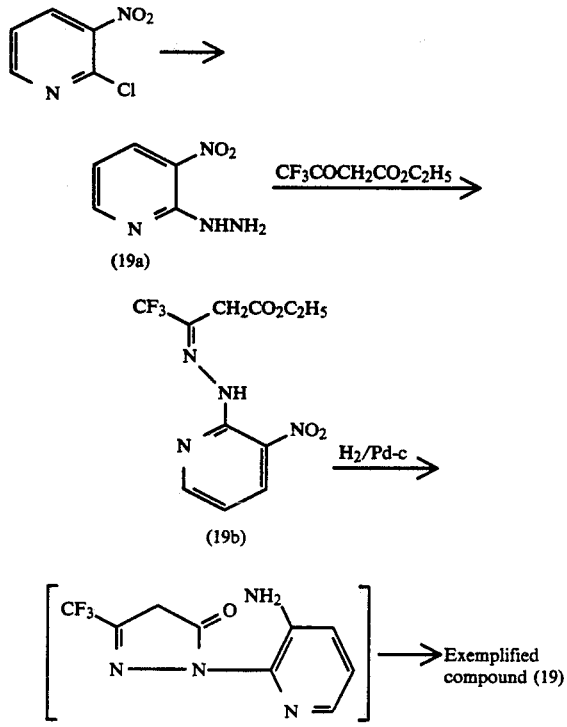

(i) Synthesis of Intermediate (I-19*a*)

15.9 g (0.1 mol) of 2-chloro-3-nitropyridine is dissolved in 80 ml of methanol. While refluxing the solution with heating, 14.3 ml (0.295 mol) of hydrated hydrazine is added slowly dropwise. After the addition, the solution is refluxed with heating for another 5 minutes to complete the reaction. Filtration of the resulting crystals followed by recrystallization of the crystals from ethanol gives 14.3 g (93% yield) of intermediate (I-19*a*).

(ii) Synthesis of intermediate (I-19*b*)

After dispersing 15.4 g (0.1 mol) of intermediate (I-19*a*) and 18.4 g (0.1 mol) of ethyl trifluoroacetoacetate in 150 ml of ethanol, the dispersion is refluxed for 2 hours with heating to complete the reaction. Filtration of the resulting crystals gives 27.8 g (87% yield) of intermediate (I-19*b*).

(iii) Synthesis of exemplified compound (I-19)

32 g (0.1 mol) of intermediate (I-19*b*) is dissolved in 150 ml of tetrahydrofuran. After adding 1.6 g of active carbon containing 5% palladium, the solution is allowed to react for 3 hours at room temperature in a hydrogen atmosphere of 1 atm. Then, the catalyst is filtered off, and the filtrate is refluxed for 3 hours with heating. After completion of the reaction, the solvent is distilled out at reduced pressure. Recrystallization of the resulting residue from ethanol gives 11.3 g (50% yield) of exemplified compound (I-19).

The structure of the product is identified on the basis of $^1$H-NMR, IR and mass spectra.

Purification of the resulting residue by means of silica gel chromatography gives 8.7 g (42% yield) of intermediate (II-9*c*).

(ii) Synthesis of exemplified compound (II-9)

In 100 ml of acetic acid is dissolved 20.6 g (0.1 mol) of intermediate (II-9*c*). The solution is refluxed for 2 hours with heating, and after completion of the reaction, the organic layer is extracted with the addition of ethyl acetate and an aqueous sodium carbonate. After distilling out the solvent at reduced pressure, the residue is recrystallized from ethanol, In this way 13.6 g (72% yield) of exemplified compound (II-9) is obtained.

The structure of the product is identified on the basis of $^1$H-NMR, IR and mass spectra.

The coupler of the invention are used usually in a range of $1\times10^{-3}$ to 1 mol, preferably in a range of $1\times10^{-2}$ to $8\times10^{-1}$ mol per mol of silver halide.

Further, the coupler of the invention can be used together with other types of cyan couplers. The processes and techniques for conventional dye forming couplers can also be applied to the coupler of the invention.

The coupler of the invention can be used as a color photograph forming material without any restriction on the type of color forming methods, and can be processed by either the coupler-in-developer process or the coupler-in-emulsion process. When used in the coupler-in-developer process, the coupler of the invention can be incorporated in a developer in the form of an aqueous alkaline solution or a solution of an organic solvent such as ethanol.

When used in the coupler-in-emulsion process, the coupler of the invention is incorporated in a photographic light-sensitive material.

In a typical manner to incorporate it, it is blended in a silver halide emulsion, and then the emulsion is coated on a support to form a color light-sensitive material.

The coupler of the invention is used in color photographic light-sensitive materials such as color negative film, color positive film and color photographic paper.

The light-sensitive materials including color photographic paper which use the coupler of the invention may be either for monochrome or for multicolor. When used in a multicolor light-sensitive material, the coupler of the invention, though may be incorporated in any layer, is usually contained in a red-sensitive silver halide emulsion layer. The multicolor light-sensitive material possesses a dye image forming component unit having a light-sensitivity in each of the three primary color regions of the spectrum. Each component unit can be composed of a single layer or multiple layers having a light-sensitivity at a specific spectral region. Component layers of the light-sensitive material, including the layer of the dye image forming component unit, can be arranged in various orders as known in the art.

A typical multicolor light-sensitive material has, on a support, a cyan dye image forming component unit comprising at least one red-sensitive silver halide emulsion layer containing at least one cyan coupler, at least one of the cyan couplers is the cyan coupler of the invention, a magenta dye image forming component unit comprising at least one green-sensitive silver halide emulsion layer containing at least one magenta coupler, and a yellow dye image forming component unit comprising at least one blue-sensitive silver halide emulsion layer containing at least one yellow coupler.

The light-sensitive material can have additional layers such as a filter layer, an intermediate layer, a protective layer and a subbing layer.

The coupler of the invention can be incorporated in an emulsion by a conventional method. For example, the coupler of the invention is dissolved singly or in combination in a single high boiling solvent with a boiling point not lower than 175° C., such as tricresyl phosphate or dibutyl phthalate, or a single low boiling solvent, such as butyl acetate or butyl propionate, or in a mixture thereof if necessary. After mixing the solution with an aqueous solution of gelatin containing a surfactant, the mixture is emulsified by use of a high-speed rotary mixer or a colloid mill, and then then it is added to a silver halide to obtain a silver halide emulsion used in the invention.

For a light-sensitive material containing the coupler of the invention, preferred silver halide compositions are silver chloride, silver chlorobromide and silver chloroiodobromide. Further, these may also be a mixed silver halide such as a mixture of silver chloride and silver bromide. That is, a particularly rapid developability is required of a silver halide emulsion used in color photographic paper; therefore, it is preferable that chlorine atoms be contained in the silver halide composition. Particularly preferred are silver chloride, silver chlorobromide and silver chloroiodobromide each containing at least 1% of silver chloride.

The silver halide emulsion is chemically sensitized by a usual method and may also be optically sensitized to a desired wavelength region.

For the purpose of preventing fog and/or maintaining photographic properties stably in the course of manufacturing, storing and photographic processing of a light-sensitive material, the silver halide emulsion may contain a compound known as antifoggant or stabilizer in the art.

The color light-sensitive material using the coupler of the invention may contain compounds usually employed in a light-sensitive material, such as an antistain agent, a dye image stabilizer, a UV absorbent, an antistatic agent, a matting agent and a surfactant.

Details of these compounds can be seen, for example, in Research Disclosure, Vol. 176, pp. 22–31 (December, 1978).

To form images, the color light-sensitive material using the coupler of the invention can be processed according to a conventional color developing method.

The color light-sensitive material using the coupler of the invention can also contain a color developing agent or a precursor thereof in its hydrophilic colloid layer, so that the light-sensitive material can be color-developed by being processed in an alkaline activating bath.

After color developing, the color light-sensitive material using the coupler of the invention is subjected to bleaching and fixing. Bleaching may be carried out simultaneously with fixing.

Fixing is usually followed by washing. Stabilizing may be carried out as a substitute for washing, or both stabilizing and washing may also be performed.

EXAMPLES

Example 1

A red-sensitive color photographic light-sensitive material, sample 1, was prepared by forming the following layers on a paper support laminated with polyethylene on both sides. Addition amounts of compounds shown below are given in values per $m^2$ unless otherwise indicated, and amounts of silver halide are in amounts of silver present.

1st layer: emulsion layer

A red-sensitive emulsion layer containing 1.2 g of gelatin, 0.30 g of a red-sensitive silver chlorobromide emulsion (silver chloride content: 96 mol %), and $9.1\times10^{-4}$ mol of comparative cyan coupler (a) dissolved in 1.35 g of dioctyl phosphate.

2nd layer: protective layer

A protective layer containing 0.50 g of gelation. As a hardener, sodium 2,4-dichloro-6-hydroxy-s-triazine was added in an amount of 0.017 g/g gelatin.

Subsequently, samples 2 to 8 of the invention were prepared in the same manner as with sample 1, except that comparative coupler (a) was replaced with the couplers shown in Table 1, addition amounts in moles were the same as that of comparative coupler (a).

Samples 1 to 8 were each exposed through an optical wedge by the usual method and then processed under the following conditions:

| (Development) | | |
|---|---|---|
| Color developing | 38° C. | 3 min 30 sec |
| Bleach-fixing | 38° C. | 1 min 30 sec |
| Stabilizing | 25–30° C. | 6 min |
| Drying | 75–80° C. | 2 min |

Compositions of processing solutions used in the respective processes were as follows:

| (Color developer) | |
|---|---|
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-Methyl-4-amino-N-ethyl-N-(β-methanesulfonamidoethyl)-aniline sulfate | 5.5 g |
| Optical whitening agent (4,4'-diaminostilbene disulfonic acid derivative) | 1.0 g |
| Potassium hydroxide | 2.0 g |

Water is added to make 100 ml, and then the pH is adjusted to 10.20.

| (Bleach-fixer) | |
|---|---|
| Ammonium ferric ethylenediaminetetracetate dihydrate | 60.0 g |
| Ethylenediaminetetracetic acid | 3.0 g |
| Ammonium thiosulfate (70% aqueous solution) | 100.0 ml |
| Ammonium sulfite (40% aqueous solution) | 27.5 ml |

The pH is adjusted to 7.1 with potassium hydroxide or glacial acetic acid, then water is added to make 1000 ml.

| (Stabilizer) | |
|---|---|
| 5-Chloro-2-methyl-4-isothiazoline-3-one | 1.0 g |
| Ethylene glycol | 10.0 g |

Water is added to make 1000 ml.

The density of processed samples 1 to 8 was measured with a Densitometer Model KD-7 (Konica Corp.). Further, each process sample was stored for 14 days in an environment of 60° C. and 80% relative humidity, and then the heat and moisture resistance of the dye image were examined.

Separately, each processed sample was irradiated in a xenon fade meter for 10 days, and then its density was measured to evaluate the light fastness. The evaluation results are shown in Table 1, where the heat and moisture resistance and the light fastness of the dye images are given in percentages of residual density of the dye image after the heat and moisture resistance test and the light fastness test relative to the initial density set at 1.0.

TABLE 1

Comparative coupler (a)

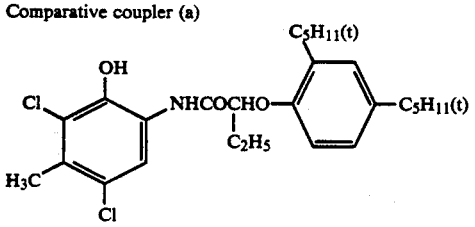

| Sample No | Coupler Used | Dye Residual Rate (%) Heat & Moisture Resistance | Light Fastness |
|---|---|---|---|
| 1 | Comparison (a) | 60 | 81 |
| 2 | Invention I-2 | 89 | 84 |
| 3 | Invention I-6 | 90 | 82 |
| 4 | Invention I-12 | 90 | 85 |
| 5 | Invention I-16 | 88 | 85 |
| 6 | Invention I-18 | 91 | 85 |
| 7 | Invention I-21 | 90 | 84 |
| 8 | Invention I-24 | 89 | 84 |

As apparent from Table 1, any of the samples containing the coupler of the invention has a dye residual rate larger than that of the sample containing the comparative coupler and is superior to it in heat and moisture resistance and light fastness.

Example 2

A red-sensitive color light-sensitive material, sample 9, was prepared by forming the following layers on a subbed cellulose triacetate film support. Addition amounts of compounds are in values per $m^2$, unless otherwise described, and the amounts of silver halide are given in amounts of silver present.

1st layer: emulsion layer

A red-sensitive emulsion layer containing 1.4 g of gelatin, 1.5 g of a red-sensitive silver iodobromide emulsion (silver iodide content: 4 mol %), and $8.0\times10^{-4}$ mol of comparative cyan coupler (b) dissolved in 1.1 g of tricresyl phosphate.

2nd layer: protective layer

A protective layer containing 1.5 g of gelatin. As a hardener, sodium 2,4-dichloro-6-hydroxy-s-triazine was added in an amount of 0.017 g/g gelatin.

Samples 10 to 16 of the invention were prepared in the same manner as with sample 9, except that the couplers shown in Table 2 were used in place of comparative coupler (b) (addition amounts in moles were the same as that of comparative coupler (b)).

The samples obtained were exposed through an optical wedge by the usual method and subjected to color development according to the following processes:

Comparative coupler (b)

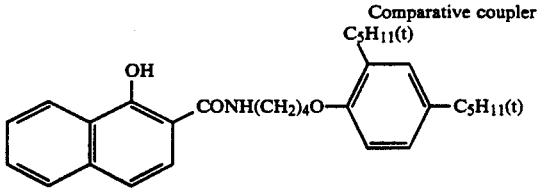

Comparative coupler (c)*

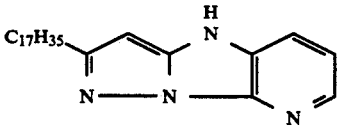

*(A compound described in J. Signalaufzeichnungsmater, Vol. 9 (1981), pp. 285-290)

| Process (processing temp. 38° C.) | Processing Time |
|---|---|
| Color developing | 3 min 15 sec |
| Bleaching | 6 min 30 sec |
| Washing | 3 min 15 sec |
| Fixing | 6 min 30 sec |
| Washing | 3 min 15 sec |
| Stabilizing | 1 min 30 sec |
| Drying | |

Compositions of processing solutions used in the respective processes were as follows:

| [Color developer] | |
|---|---|
| 4-Amino-3-methyl-N-ethyl-N-(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |

Water is added to make 1000 ml, and then the pH is adjusted to 10.6 with sodium hydroxide.

| [Bleach] | |
|---|---|
| Ammonium ferric ethylenediaminetetracetate | 100.0 g |
| Diammonium ethylenediaminetetracetate | 10.0 g |
| Ammonium bromide | 150.0 g |
| Glacial acetic acid | 10.0 g |

Water is added to make 100 ml, and then the pH is adjusted to 6.0 with aqueous ammonia.

| [Fixer] | |
|---|---|
| Ammonium thiosulfate | 175.0 g |
| Anhydrous ammonium sulfite | 8.6 g |
| Sodium metasulfite | 2.3 g |

Water is added to make 1000 ml, and then the pH is adjusted to 6.0 with acetic acid.

| [Stabilizer] | |
|---|---|
| Formalin (37% aqueous solution) | 1.5 ml |
| Koniducks (product of Konica Corp.) | 7.5 ml |

Water is added to make 1000 ml.

The transmitted density of processed samples 9 to 16 was measured with a Densitometer Model KD-7 (Konica Corp.). Further, each processed sample was stored 14 days in high temperature and humidity environment of 60° C. and 80% relative humidity, and then the heat and moisture resistance of the dye image was examined.

Separately, each processed sample was irradiated in a xenon fade meter for 10 days to examine the light fastness. The results are shown in Table 2, where the heat and moisture resistance and the light fastness of the dye image are given in percentages of residual density of the image of dye after the heat and moisture resistance test and the light fastness test relative to the initial density set at 1.0.

Moreover, the color-developed image of each processed sample was enlarged ten times on Konica Color Paper, followed by color paper development (CPK-18P). Then, the color reproduction was visually evaluated using five ratings. In the column of color reproduction in printing of Table 2 which shows the results, the larger the value is, the better the color reproduction becomes.

TABLE 2

| Sample No. | Coupler Used | Dye Residual Rate (%) Heat & Moisture Resistance | Light Fastness | Color Reproduction in Printing |
|---|---|---|---|---|
| 9 | Comparison (b) | 70 | 80 | 4 |
| 10 | Comparison (c) | 86 | 82 | 2–3 |
| 11 | Invention I-4 | 87 | 83 | 5 |
| 12 | Invention I-7 | 89 | 85 | 5 |
| 13 | Invention I-10 | 91 | 84 | 4–5 |
| 14 | Invention I-14 | 92 | 84 | 5 |
| 15 | Invention I-17 | 90 | 85 | 5 |
| 16 | Invention I-20 | 88 | 84 | 5 |

As apparent from Table 2, any of the samples using the coupler of the invention has a dye residual rate larger than that of the sample using comparative coupler (b) and is excellent in heat and moisture resistance, light fastness, and color reproduction.

The samples using the coupler of the invention excel the sample using comparative coupler (c) in color reproduction.

Example 3

Red-sensitive color reversal photographic light-sensitive materials containing the coupler shown in Table 3, samples 17 to 22, were prepared by forming the following layers on a triacetylcellulose film support.

1st layer: emulsion layer

A red-sensitive emulsion layer containing 1.4 g of gelatin, 0.5 g of a red-sensitive silver chlorobromide emulsion (silver chloride content: 96 mol %), and $9.1\times10^{-4}$ mol of coupler shown in Table 3 dissolved in 1.5 g of dibutyl phthalate.

2nd layer: protective layer

A protective layer containing 0.5 g of gelatin. As a hardener, sodium 2,4-dichloro-6-hydroxy-s-triazine was added in an amount of 0.017 g/g gelatin.

The samples obtained as above were exposed through an optical wedge by the usual method and then processed as follows:

[Reversal processing]

| Process | Time | Temp. |
|---|---|---|
| 1st developing | 6 min | 38° C. |
| Washing | 2 min | 38° C. |
| Fogging | 2 min | 38° C. |
| Color developing | 6 min | 38° C. |
| Conditioning | 2 min | 38° C. |
| Bleaching | 6 min | 38° C. |
| Fixingü | 4 min | 38° C. |
| Washing | 4 min | 38° C. |
| Stabilizing | 1 min | room temp. |
| Drying | | |

Processing solutions of the following compositions are used.

| | |
|---|---|
| [1st Developer] | |
| Sodium tetrapolyphosphate | 2.0 g |
| Sodium sulfite | 20.0 g |
| Hydroquinone-monosulfonate | 30.0 g |
| Sodium carbonate (monohydrate) | 30.0 g |
| 1-Phenyl-4-methyl-4-hydroxymethyl-3-pyrazolidone | 2.0 g |
| Potassium bromide | 2.5 g |
| Potassium thiocyanate | 1.2 g |
| Potassium iodide (0.1% aqueous solution) | 2 ml |
| Water is added to make | 1000 ml |
| [Fogging solution] | |
| Hexasodium nitrilotrimethylenephosphonate | 3.0 g |
| Stannous chloride (dihydrate) | 1.0 g |
| p-Aminophenol | 0.1 g |
| Sodium hydroxide | 5.0 g |
| Glacial acetic acid | 15 ml |
| Water is added to make | 1000 ml |
| [Color developer] | |
| Sodium tetrapolyphosphate | 2.0 g |
| Sodium sulfite | 7.0 g |
| Sodium tertiary phosphate (dodecahydrate) | 36.0 g |
| Potassium bromide | 1.0 g |
| Potassium iodide (0.1% aqueous solution) | 90 ml |
| Sodium hydroxide | 3.0 g |
| Citrazinic acid | 1.5 g |
| N-Ethyl-N-β-methanesulfonamidoethyl-3-methyl-4-aminoaniline sulfate | 11.0 g |
| Ethylenediamine | 3.0 g |
| Water is added to make | 1000 ml |
| [Conditioning solution] | |
| Sodium sulfite | 12.0 g |
| Sodium ethylenediaminetetracetate (dihydrate) | 8.0 g |
| Thioglycerine | 0.4 ml |
| Glacial acetic acid | 3 ml |
| Water is added to make | 1000 ml |
| [Bleach] | |
| Sodium ethylenediaminetetracetate (dihydrate) | 2.0 g |
| Ammonium ferric ethylenediaminetetracetate (dihydrate) | 120.0 g |
| Potassium bromide | 100.0 g |
| Water is added to make | 1000 ml |
| [Fixer] | |
| Ammonium thiosulfate | 80 g |
| Sodium sulfite | 5 g |
| Sodium bisulfite | 5 g |
| Water is added to make | 1000 ml |
| [Stabilizer] | |
| Formalin (37% aqueous solution) | 5 ml |
| Koniducks (product of Konica Corp.) | 5 ml |
| Water is added to make | 1000 ml |

The heat & moisture resistance and light fastness of the dye image obtained on each sample were evaluated in the same manner as in Example 2. The results are shown in Table 3.

TABLE 3

| Sample No. | Coupler Used | Dye Residual Rate (%) Heat & Moisture Resistance | Light Fastness |
|---|---|---|---|
| 17 | comparison (a) | 59 | 81 |
| 18 | invention I-3 | 90 | 83 |
| 19 | invention I-5 | 86 | 83 |
| 20 | invention I-13 | 89 | 84 |
| 21 | invention I-15 | 91 | 86 |
| 22 | invention I-22 | 90 | 83 |

As apparent from Table 3, any of the samples using the coupler of the invention has a dye residual rate larger than that of the sample using comparative coupler and is excellent in both heat & moisture resistance and light fastness.

Example 4

A heat-developable light-sensitive material, sample 30, was prepared by forming a heat-developable layer consisting of the following components, amounts are per $m^2$, on a transparent polyethylene terephthalate film support.

| | |
|---|---|
| Silver salt of benzotriazole | 0.6 g |
| Gelatin | 3.0 g |
| Reducing agent*1 | 0.97 g |
| Coupler (I-8) | 1.0 g |
| Silver iodobromide (in terms of silver) | 0.45 g |
| Polyvinyl pyrrolidone | 1.0 g |
| Benzotriazole | 0.02 g |
| Inhibitor*2 | |
| Thermal solvent*3 | 4.5 g |

After being exposed imagewise, the above light-sensitive material was contacted with an image receiving material prepared by coating polyvinyl chloride on photographic baryta paper, then these were heat-processed for 1 minute at 150° C., so that a transferred cyan image was obtained in good conditions on the image receiving material.

*1)

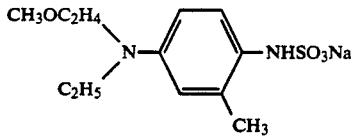

*2)

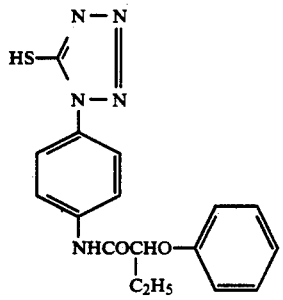

*3)

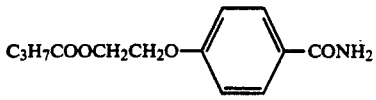

Example 5

Samples 31 to 38 were prepared in the same manner as in Example 1 using the couplers shown in Table 4. The samples were exposed and processed identically in Example 1. The dye residual rate of each sample was measured by the method used in Example 1.

TABLE 4

| Sample No. | Coupler Used | Dye Residual Rate (%) |
|---|---|---|
| 31 | Comparison (a) | 58 |
| 32 | Invention II-2 | 86 |
| 33 | Invention II-6 | 89 |
| 34 | Invention II-8 | 89 |
| 35 | Invention II-12 | 90 |
| 36 | Invention II-13 | 86 |
| 37 | Invention II-20 | 87 |
| 38 | Invention II-24 | 84 |

As apparent from Table 4, any of the samples using the coupler of the invention are higher than the sample using the comparative coupler in dye residual rate and thereby indicate less color fading under high temperature and high humidity conditions.

Example 6

Samples 39, 40 and 41 were prepared in the same procedure as with sample 1 of Example 1, except that 0.35 g of a green-sensitive silver chlorobromide emulsion (silver bromide content: 85 mol %) was used in place of 0.30 g of the red-sensitive silver chlorobromide emulsion (silver chloride content: 96 mol %), and that $5.1\times10^{-4}$ mol each of magenta couplers (II-4), (II-14) and (II-22) of the invention were used in the respective samples in place of $9.1\times10^{-4}$ mol of comparative cyan coupler (a). The samples were exposed and processed in the same manner as in Example 1.

These processed samples were evaluated for heat & moisture resistance as in Example 1. Further, the processed samples were each irradiated for 3 days in a xenon fade meter, and then the density was measured to find out the density of residual dye after irradiation relative to the initial density set at 1.0, as a measure of the light fastness.

The evaluation results clearly showed the effect of the invention; that is, the magenta dye images obtained were very stable to heat, moisture and relatively fast to light.

Example 7

Red-sensitive color reversal light-sensitive materials containing the coupler shown in Table 5, samples 42 to 46, were prepared in the same manner as in Example 3. The samples were exposed and processed identically in Example 3.

The heat & moisture stability of the dye image was examined as in Example 1 for each of the samples processed as above. The results are shown in Table 5.

In this example, the transmitted density was measured with the above Densitometer Model KD-7R.

TABLE 5

| Sample No. | Coupler Used | Dye Residual Rate (%) |
|---|---|---|
| 42 | Comparison (a) | 60 |
| 43 | Invention II-5 | 85 |
| 44 | Invention II-10 | 83 |
| 45 | Invention II-15 | 84 |
| 46 | Invention II-21 | 82 |

As apparent from Table 2, any of the samples using the coupler of the invention is superior to the sample using the comparative coupler in dye residual rate and thereby excellent in heat & moisture resistance.

Example 8

Samples 47 and 48 were prepared in the same way as with sample 12 of Example 3, except that 0.58 g of a green-sensitive silver chlorobromide emulsion (silver bromide content: 85 mol %) was used in place of 0.5 g of the red-sensitive silver chlorobromide emulsion (silver chloride content: 96 mol %), and that $5.1\times10^{-4}$ mol each of magenta couplers (II-18) and (II-22) of the invention were used in the respective samples in place of $9.1\times10^{-4}$ mol of comparative cyan coupler (a). The samples were exposed and processed in the same manner as in Example 7.

The processed samples were evaluated for heat & moisture resistance and light fastness as in Example 6. The results showed that the magenta dye images obtained were fast to heat & moisture and to light, and that the effect of the invention was clearly exhibited.

What is claimed is:

1. A silver halide color photographic light-sensitive material comprising a support having thereon a silver halide emulsion layer containing a coupler represented by the following formula Ia, Ib, Ic, Id, Ie, IIa, IIb, IIc, IId, IIe or IIf:

(Ia)

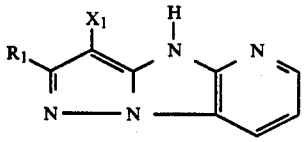

(Ib)

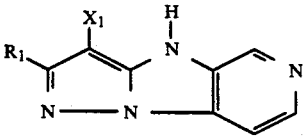

(Ic)

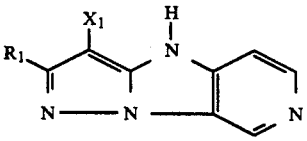

(Id)

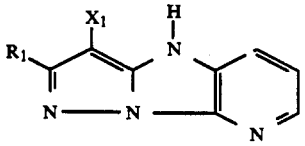

(Ie)

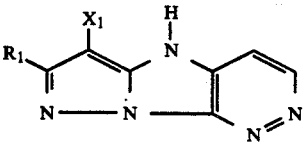

(IIa)

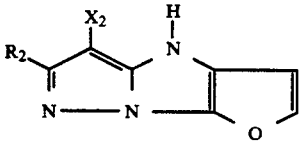

-continued (IIb)

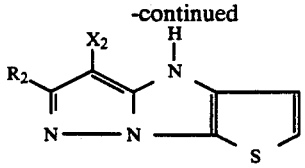

(IIc)

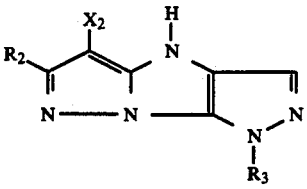

(IId)

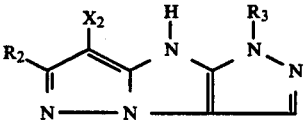

(IIe)

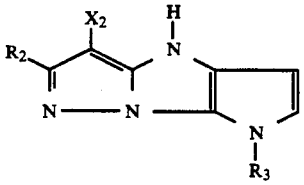

(IIf)

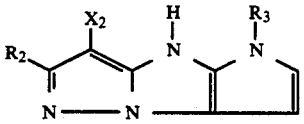

wherein $R_1$ is a hydrogen atom, a cyanomethyl group, an aminomethyl group, a pentachlorophenyl group, a 2,4,6-trinitrophenyl group, a sulfonamido group, a cyano group, a nitro group, a sulfonyl group, a β-carboxyvinyl group, a sulfinyl group, β,β-dicyanovinyl group, a halogenated alkyl group, a formyl group, a carboxy group, an alkoxycarbonyl group, an aryloxycarbonyl group, 1-tetrazolyl group, 5-chloro-1-tetrazolyl group, a carbamoyl group or a sulfamoyl group;

$X_1$ is a hydrogen atom or a substituent capable of splitting off upon reaction with the oxidation product of a color developing agent;

$Y_1$ is a hydrogen atom or a substituent;

$R_2$ is a hydrogen atom or a substituent;

$Y_2$ is a hydrogen atom or a substituent; and $X_2$ is a hydrogen atom or a substituent capable of splitting off upon reaction with the oxidation product of a color developing agent $R_3$ is a substituent.

2. The light-sensitive material of claim 1, wherein said coupler is represented by formula Ia, Ib, Ic, Id or Ie.

3. The light-sensitive material of claim 1, wherein said coupler is represented by formula IIa, IIb, IIc, IId, IIe or IIf.

4. The light-sensitive material of claim 1, wherein said silver halide emulsion layer contains said coupler in an amount of from $1\times10^{-3}$ miles to 1 mole per mol of silver halide contained in said emulsion layer.

5. The light-sensitive material of claim 4, wherein said silver halide emulsion layer contains said coupler in an amount of from $1\times10^{-2}$ moles to $8\times10^{-1}$ moles per mole of silver halide contained in said emulsion layer.

6. The light-sensitive material of claim 1, wherein said silver halide emulsion layer comprises silver halide containing at least 1 mol % of silver chloride.

* * * * *